United States Patent [19]

Galley

[11] 4,356,753

[45] Nov. 2, 1982

[54] MUSICAL ELECTRO MAGNETIC ANALOG SYNTHESIZER CONTROLLED ROCKET ENGINE

[76] Inventor: Paul L. Galley, 2001 Pierce St., Flint, Mich. 48503

[21] Appl. No.: 229,461

[22] Filed: Jan. 29, 1981

[51] Int. Cl.[3] ..... G10D 13/02; G10H 3/02

[52] U.S. Cl. ..... 84/1.04; 84/411 R; 84/DIG. 12; 340/386

[58] Field of Search ..... 84/1.04–1.08, 84/1.14, 411 R, DIG. 12, 1.09; 340/385, 386

[56] References Cited

U.S. PATENT DOCUMENTS 2,917,736 12/1959 Marotta ..... 340/386

3,113,304 12/1963 Lindley ..... 340/385 X 3,412,394 11/1968 Lewis et al. ..... 340/386

3,549,775 12/1970 Kaminsky ..... 84/DIG. 12

3,659,032 4/1972 May ..... 84/DIG. 12

*Primary Examiner*—Stanley J. Witkowski

*Attorney, Agent, or Firm*—Harry R. Dumont

[57] ABSTRACT

A musical instrument combination including a rocket engine type combustion chamber and a system for firing it either by single drum beat control or by variable frequency control pulses. The effect achieved by the rocket engine output sound is similar to that of a pipe organ and resonator and further is of a pitch controllable by the barrel length and diameter of the rocket engine chamber exhaust structure.

11 Claims, 3 Drawing Figures

MUSICAL ELECTRO MAGNETIC ANALOG SYNTHESIZER CONTROLLED ROCKET ENGINE

BACKGROUND OF THE INVENTION

A number of prior art devices are known in which a sound output is obtainable by igniting apparatus generally similar to rocket engine combustion chambers thus to give an explosive output. In most cases, these devices emit only a single sound and are not operable in musically timed or synchronous relationship to other musical instruments. One system of this type is shown and described in R. J. Marotta U.S. Pat. No. 2,917,736 issued on Dec. 15, 1959 for "Pest Control Device". A similar device used to emit a single loud sound to repel birds, animals or pests is shown and described in R. M. Lewis et al, U.S. Pat. No. 3,412,394 issued Nov. 19, 1968 for "Photocell Controlled Pest, Bird, and Animal Chaser". In that system again the actuation of the device is controlled by a photocell with a single activation of the combustion chamber resulting.

A still further sound emitting device also not of a musical type is shown in F. M. Lindley U.S. Pat. No. 3,113,304 issued on Dec. 3, 1963 for "Pest Control Device".

SUMMARY OF THE PRESENT INVENTION

The present invention is directed toward a combination of a musical instrument such as a drum that is used to control the firing of a rocket engine type chamber which includes a flared jet sound release port for providing a controllable pitch output. The firing of the jet engine type combustion chamber is accomplished in timed relationship with a drum beat and through a switch activated by the drummer. In an alternate embodiment of the invention, the drum stick can be used to activate a separate oscillator to provide a variable frequency firing of the combustion chamber which is initiated by the drummer. In a still further embodiment of the invention, a variable frequency oscillator is connectable for firing the combustion chamber with a selectively preset frequency.

BRIEF DESCRIPTION OF THE DRAWINGS

The present invention will now be described in the accompanying specification and as shown in the accompanying drawings, in which.

DETAILED DESCRIPTION OF THE PREFERRED EMBODIMENT

Figure 1:
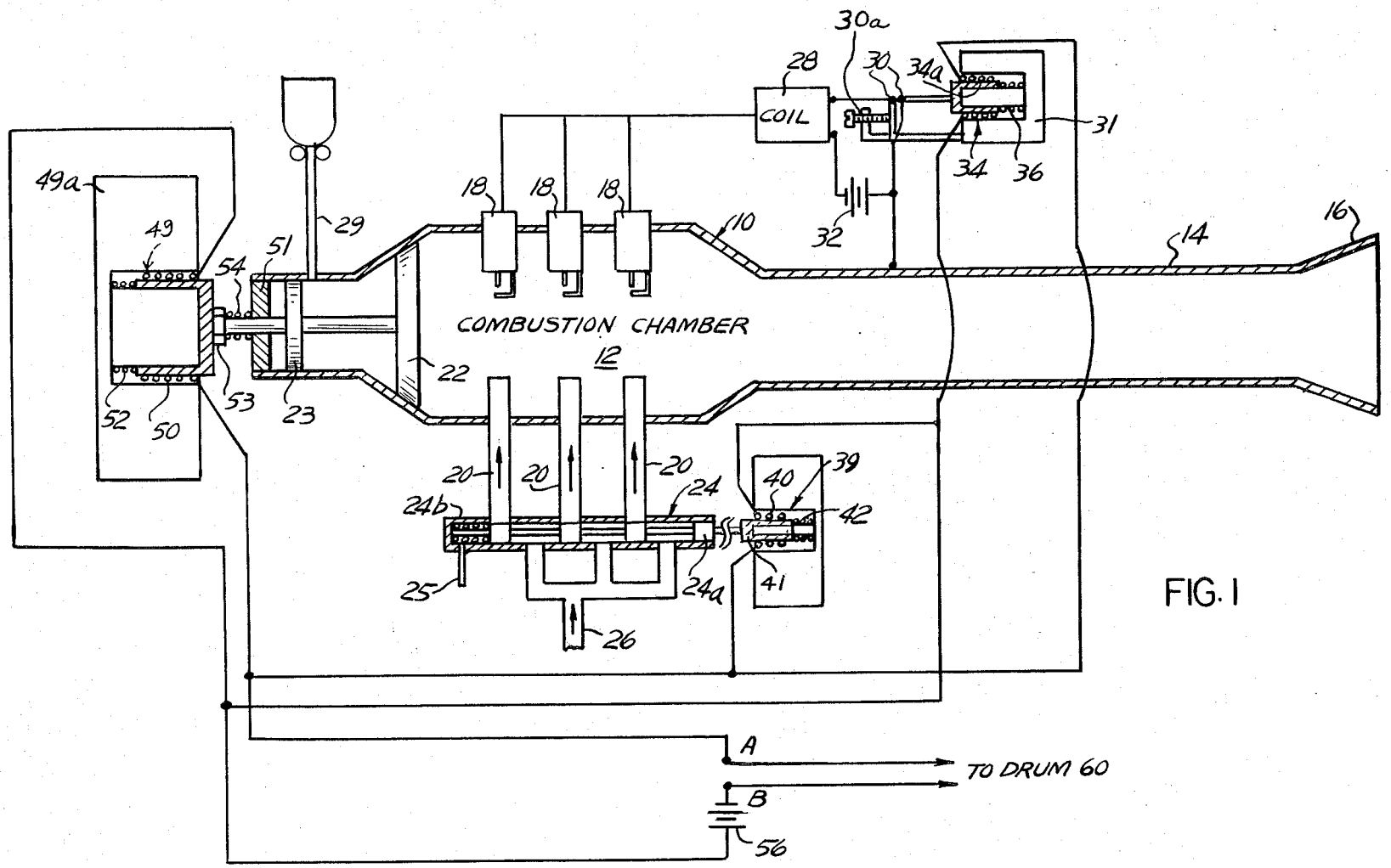
FIG. 1 is a combined diagrammatic and schematic showing of the combustion chamber and its timing control elements.

FIG. 1 shows the basic elements of the apparatus including a rocket engine apparatus 10. The rocket engine 10 includes a combustion chamber 12 of generally cylindrical configuration and located at its left hand end. A barrel 14 is located rightwardly of the combustion chamber 12 and its length and diameter may be appropriately sized to provide the desired output sound pitch. A rocket sound release port 16 is provided at the right hand end of the barrel 14. Arrayed within the combustion chamber 12 are a plurality of spark plugs 18 or other igniting devices. Opposite the spark plugs 18 are provided a like plurality of input ports 20 for admitting combustible liquid fuel to the combustion chamber 12. An injector valve operator 22 is longitudinally movable within the left end of the combustion chamber 12 for compressing fuel and oxygen into the chamber prior to ignition. Operatively connected with the valve 22 is a piston 23. Also associated with the chamber 12 and with the fuel input ports 20, there is provided a piston type fuel valve 24 which is operated to open the lower ends of the tubes or ports 20 to a fuel supply and pump located at the lower fuel input tube 26. The detail of these last parts are not shown in the interest of simplicity and brevity and are well known in the art.

Associated with the spark plugs 18 is a firing circuit including a coil 28, a pair of normally open contacts 30, a magnet 31, and a DC source 32. The contacts 30 are closed at predetermined times as will be explained hereinafter in the "Description of Operation" by the action of a relay coil 34 and associated copper core **34*a*. A biasing spring 36 is shown in the position it is mounted at the right hand end of the relay coil 34. The points for contacts 30 are adjustable for sensitivity by a threaded adjustment screw 30*a***.

A further electro-magnetic relay 39 and its coil 40 are shown with the core 41 connected to the right hand end of the piston type valve 24 and its spool type operator **24*a*. A tube 25 is preferably included at the end of the valve 24 to provide drainage of fuel that might escape into the left valve chamber. A biasing spring 24*b* is connected at the left hand end of the valve operator 24*a*. A further biasing spring 42 is shown at the right hand end of the valve operator 24*a*** for maintaining it in a normally closed position.

The injector valve 22 has associated with its left hand end an electro-magnetic relay 49, a magnet **49*a* and coil 50 which may be of the type used with the firing circuit. A pair of springs 52 and 54 are included for holding the valve 22 in a normally centered or inactive position. The valve operator 22 includes a valve guide 51 at its left hand end. A nut 53 is threadably mounted on the left hand end of the valve stem to allow adjustment. Responsive to the activation of the relay coil 50, the valve 22 is moved to inject oxygen from an inlet tube 29 for a firing cycle within the combustion chamber 12** as will be explained in more detail in the section "Description of Operation" hereinafter.

At the lower end of the FIG. 1 drawing, are shown signal input terminals A-B which receive control pulses to fire the several above described relays 34, 39 and 49 in timed relationship to fire the engine thus to produce the desired output sound or sound trains as desired. A DC source 56 is connected in circuit as shown.

Figure 2:
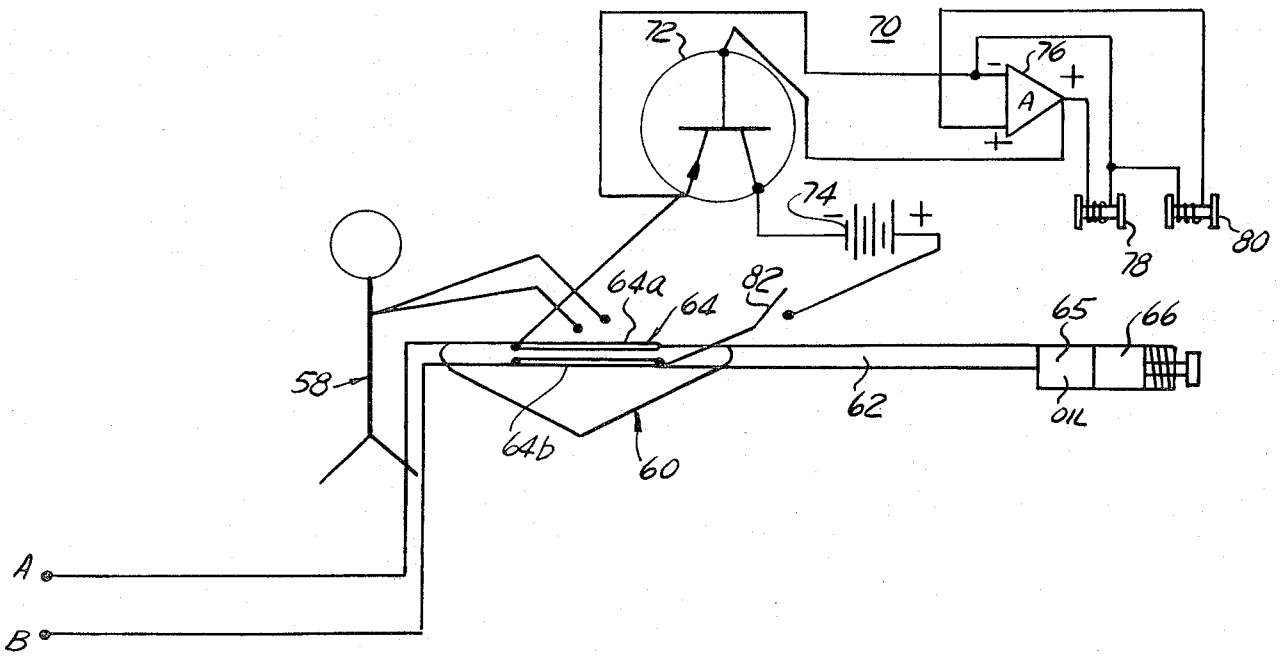
FIG. 2 is a combined diagrammatic and schematic showing of a drum initiated switch and space-pick type oscillator for firing the combustion chamber and apparatus of FIG. 1.

FIG. 2 shows one embodiment of the invention in which a drummer 58 and a drum 60 are shown. Included in the upper striking surface of the drum 60 is an oil filled diaphragm 62 having a tubular reservoir 64 and a plunger 66 which can be selectively adjusted to vary the tension of the drum striking surface. The switch 64 is shown with its two operating elements **64*a* and 64*b* located in spaced relationship at opposite surfaces of the diaphragm 62. Responsive to a drum beat stroke on the upper switch element 64*a*, there will be provided a closure of the switch 64 to connect the DC source 56** of FIG. 1 and fire the several electro-magnetic relays shown and referred to in connection with that drawing.

In FIG. 2 there is also shown a space-pick type oscillator circuit 70 that includes a firing transistor 72, a DC source 74, an amplifier 76 and a pair of spaced coils 78 and 80. It will be understood that the frequency of oscillation and the frequency of firing of the rocket engine 10 depend on the spaced relationship preset between the two coils 78, 80. The oscillating control pulse output from the circuit 70 is placed in circuit by closure of a series switch 82. It will be understood that when single beat operation of the rocket engine 10 is desired the switch 82 will be left in its open position. Where repeated firing and a continuous train of output sounds are desired from the rocket engine 10, the switch 82 will be held in its closed position by a drum stick or by direct manual pressure.

Figure 3:
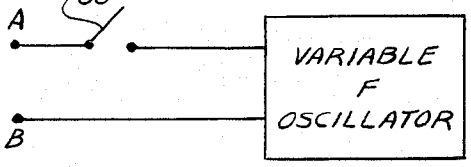
FIG. 3 shows a still different embodiment of the invention including a variable frequency oscillator connectable for the firing of the apparatus of FIG. 1.

FIG. 3 shows a different type of input circuit for firing the rocket engine 10 and the manner in which it may be selectively coupled to the terminals A, B through the opening or closure of a series switch 86. A variable frequency oscillator 88 can be placed in circuit and a frequency range anywhere between 100 or 500 up to 1,000 to 2,000 Hz. or even more can be preset depending on the sound output desired. It will further be seen that the FIG. 3 circuit can be operated independently of any musical instrument such as the drum 60 that was illustrated in FIG. 2 of the first embodiment.

DESCRIPTION OF OPERATION

The operation of the present invention as it is used to provide a single emphatic rocket engine output sound will now be described with respect to FIGS. 1 and 2. In the single beat operation, switch 82 is left in its opened position. The drummer 58 strikes the upper surface of the diaphragm 62 sharply thus closing the switch 64 and providing an electrical impulse from the DC source 56 of FIG. 1. This will serve to operate injector valve 22 through activating the relay 49 coil 50 which preferably would have a permanent type magnet 49*a* to provide operation for a single beat or over a higher frequency range as will be later described. The valve 24 is also operated to provide fuel flow through the ports 20 from the fuel source, into the combustion chamber 12 for mixture with oxygen also admitted to the chamber. The opening of the valve 24 to admit the fuel to the ports 20 is initiated through the timed operation of the coil 39 and the valve actuator spool 24*a*.

At the same time, a firing spark is provided through the spark plugs 18 through the closure of the contacts 30. Thus an electrical impulse from the DC source 32 is provided from the spark coil 28 for the actual pulsed firing of the spark plugs 18. Here again, closure of the contacts 30 is provided through an electro-magnetic device including the coil 34. Also associated with the coil 34 is a permanent magnet 31 to provide the faster operation required when other than single beat operation is initiated. The sound emitted through the barrel 14 and the port 16 is one having a striking sound characteristic not unlike that of a pipe organ with resonator.

The operation will now be described for a multiple beat operation of the rocket engine 10. In this mode of operation, the control input impulses for firing and otherwise controlling the elements of the rocket engine 10 come from an oscillator circuit 70 as shown in FIG. 2. In the firing circuit as shown in FIG. 2, the operator 58 can selectively close the switch 64 for single beat operation and can then strike and hold closed the switch 82 to provide operation of the upper oscillator circuit 70 for multiple beat operation at a frequency which can be preset by the mechanical spacing of the coils 78, 80. Thus the operator with his stick can go back and forth between single and oscillating operation of the jet engine 10. This can be achieved by operation of either of the two switches 64 or 82 in the order desired by the drummer 58.

FIG. 3 circuit is one shown operable along with the circuit of FIG. 1 and a rocket engine 10 to provide a variable frequency firing. The musician can operate the device quite independently of any other musical instrument to provide operation over a broad range, for example from 100 to 2,000 Hz.

It will thus be seen that I have provided by my invention a new and versatile musical instrument of the rocket engine type. It is operable in conjunction with another musical instrument or independently operable to provide a distinctive and controllable sound output.

I claim:

1. A rocket engine type musical instrument, comprising:

a firing chamber of preselected pitch determining length and diameter;

a plurality of igniting means mounted in said chamber;

a fuel source operably connected to provide fuel into said chamber proximate said igniting means;

means for injecting oxygen into said chamber and mixing it with the fuel for ignition;

a barrel and port connected to said chamber to provide a sound output of predetermined pitch from said chamber; and means for operating said igniting means, said fuel source and said injecting means at a selectively predetermined frequency for providing a controllable and continuously variable frequency explosive sound output from said port.

2. The combination as set forth in claim 1 wherein said last mentioned means includes a plurality of electro-magnetic relays and a variable frequency control circuit for operating them.

3. The combination as set forth in claim 1 wherein said last-mentioned means includes a switch operably associated with a drum and manually operated by a drummer.

4. The combination as set forth in claim 1 wherein a variable frequency space-pick type oscillator is included having its output operably connected to said last mentioned means for controlling its sound frequency output.

5. The combination as set forth in claim 4 wherein said oscillator includes a pair of coils having a mutual spacing preset to determine such frequency.

6. The combination as set forth in claim 1 wherein said last mentioned means comprises a plurality of relays and wherein a variable frequency oscillator is included and a switch is connected in circuit with it and said relays for providing a variable frequency control pulse output from said oscillator to said relays.

7. The combination as set forth in claim 6 wherein said relays each include permanent magnets and electromagnetic copper cores for relatively high frequency operation.

8. The combination as set forth in claim 1 wherein said last mentioned-means includes a drum having a striking surface and including a drum mounted switch mounted proximate the drum striking surface for single beat operation.

9. The combination as set forth in claim 8 wherein said switch has its contacts separated one from the other by a variable pressure diaphragm.

10. The combination as set forth in claim 1 wherein said sound output is of a pitch predetermined by the barrel length and diameter.

11. The combination as set forth in claim 4 in which said oscillator output is of an amplitude presettable to control the volume of the explosive sound output.

* * * * *